US005706945A

United States Patent [19]

Saarinen et al.

[11] Patent Number: 5,706,945

[45] Date of Patent: Jan. 13, 1998

[54] METHOD AND AN APPARATUS FOR PACKING CARDBOARD END COVERS OF PAPER ROLLS AND A PACKAGE

[75] Inventors: Vesa Saarinen, Orivesi; Esko Nykänen, Heinola, both of Finland

[73] Assignee: Pakenso Oy, Heinola, Finland

[21] Appl. No.: 489,194

[22] Filed: Jun. 9, 1995

[30] Foreign Application Priority Data

Jun. 20, 1994 [FI] Finland ..... 942959

[51] Int. Cl.[6] ..... B65D 85/00; B65B 11/00

[52] U.S. Cl. ..... 206/445; 53/436; 53/461

[58] Field of Search ..... 53/436, 459, 461–466; 206/0.8, 0.81–0.84, 303, 397, 398, 400, 413, 445, 446; 229/87.2, 87.05

[56] References Cited

U.S. PATENT DOCUMENTS

| | | | |
|---|---|---|---|
| 1,871,805 | 8/1932 | Parsons et al. | 206/445 |
| 2,255,432 | 9/1941 | Moore | 206/446 |
| 2,608,810 | 9/1952 | Smathers . | |
| 2,962,848 | 12/1960 | Wilson . | |
| 3,120,337 | 2/1964 | Thomsen | 206/446 |
| 3,924,375 | 12/1975 | Brenner . | |
| 4,765,464 | 8/1988 | Ristvedt | 206/445 |

FOREIGN PATENT DOCUMENTS

| | | |
|---|---|---|
| 0 305956 A2 | 8/1988 | European Pat. Off. . |
| A-305956 | 3/1989 | European Pat. Off. . |
| 719595 | 6/1942 | Germany . |
| 2147 277 | 5/1973 | Germany . |
| A-2434805 | 1/1976 | Germany . |
| 3119263A1 | 6/1982 | Germany . |

*Primary Examiner*—Jimmy G. Foster

*Attorney, Agent, or Firm*—Townsend & Townsend & Crew LLP

[57] ABSTRACT

The invention relates to a method and an apparatus for packing end covers of paper rolls and a package for end covers (2, 2*a*) of paper rolls. In the method, end covers (2, 2*a*) are compressed in a pile in the axial direction of the pile, after which the end cover pile is wrapped in a protective paper (1) and the edges (1*a*) of the paper are folded and fastened onto the outermost end covers (2*a*) of the end cover pile. The apparatus has compression surfaces between which the end covers (2, 2*a*) are stacked, rotating reels on which the end cover pile can revolve when it is compressed so that the protective paper (1) can be wrapped around the end cover pile, and fixing means with which the edges (1*a*) of the protective paper (1) are folded over the outermost end covers (2*a*) and fastened onto them with glue. In the package, end covers (2) are compressed in a pile in the axial direction of the pile, and the end cover pile is wrapped in a protective paper (1) that is fastened at its edges (1*a*) onto the outer surface of the outermost end covers (2*a*).

6 Claims, 2 Drawing Sheets

Figure 1:
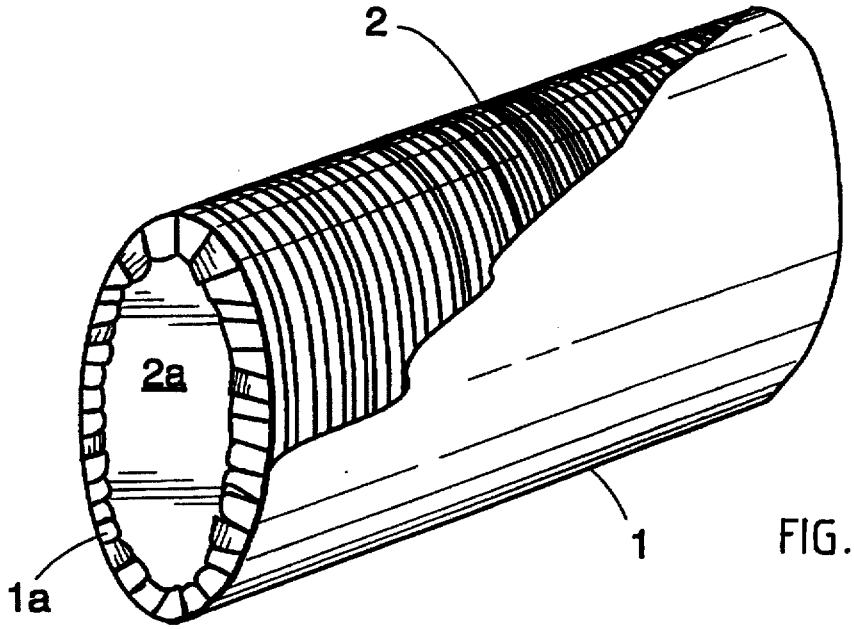

METHOD AND AN APPARATUS FOR PACKING CARDBOARD END COVERS OF PAPER ROLLS AND A PACKAGE

The invention relates to a method for packing end covers of paper rolls, in which method the end covers are stacked and fastened into a pile for transportation. The invention also relates to an apparatus for packing end covers of paper rolls. The invention further relates to a package for packing end covers of paper rolls for transportation.

Cardboard end covers are used in packing paper rolls for transportation from a paper mill to a customer. In this connection, paper rolls refer to rolls made of paper, paperboard or any like fibre web. End covers are made separately at a mill manufacturing a suitable kind of cardboard, after which the end covers are transported packed to the user. Cardboard suitable for manufacturing end covers includes, for example, corrugated fibreboard or some other suitably flexible cardboard material. A typical way of packing end covers is to place a pile of end covers between plywood or other separate boards and tie them with a binding strap or the like. This is generally done by stacking the end covers onto a suitable base, after which the pile with a plywood end board or the like is tied with binding straps onto the base. For moisture-proofing the package is typically wrapped in plastic or has a shrink-on hood that is shrunk over the entire platform package.

The drawback of known ways of packing is that packing is expensive and the transportation of separate protective boards and platforms back and forth between the customer and the end cover manufacturer is expensive and difficult. Furthermore, a package manufactured in this way contains components that will cause waste problems, which is undesirable.

It is an object of the invention to provide a method and an apparatus for packing end covers of paper rolls with which to avoid the above-mentioned drawbacks and to produce a simple and easy-to-use, recyclable package. A further object of the invention is to provide a package for end covers. The method of the invention is characterized in that the end covers are stacked into a pile comprising only end covers, the end cover pile is compressed in its axial direction, the compressed end cover pile is wrapped in a protective paper that is wider than the width of the axial direction of the pile so that it envelops the entire end cover pile, the edges of the protective paper outside of the ends of the end cover pile are folded and fastened onto the outermost end covers of the end cover pile so that the protective paper and the outermost ends of the end cover pile form a unitary package, and that the end cover pile is after this released from compression. The apparatus is characterized in that the apparatus has compression means for compressing end covers in a pile, means for wrapping a protective paper around the compressed end cover pile and folding and fixing means for folding the edges of the protective paper over the outer surface of the outermost end covers and for fastening the edges onto them. The package of the invention is characterized in that the package comprises end covers piled and compressed in the direction of the axis of the pile into a smaller space than their free space, a protective paper around the end covers, enveloping the pile of end covers, and that the protective paper is fastened at the edges onto the outermost end covers of the end cover pile so that they form a unitary package with the protective paper.

The essential idea of the invention is that the compressibility and flexibility of the end covers is made use of in compressing the covers in a pile, after which the protective paper wrapped around them and fastened onto the outermost end covers is tightened so that the package will be rigid and firm when the end cover pile is released from compression.

The essential idea of the apparatus of the invention is that it has means for compressing end covers in the direction of the pile so that an end cover pile with an outward flexibility is achieved. Another essential idea of the apparatus is that it has means for wrapping the protective paper around the end covers and for fastening the edges so that a tubular covering roll is formed. A further essential idea of the apparatus is that it has fixing means for folding the edges of the protective paper at the end of the package or cutting them into suitable strips and folding them on top of the outermost end covers and fastening them onto the covers in order to make a unitary and firm package.

The essential idea of the package of the invention is to use the outermost end covers of the end cover pile in making the package so that the protective paper is fastened onto the outermost end covers in such a way that when the compressed end covers try to resume their free shape, the package will be neat and tight, and at the same time firm.

The advantage of the invention is that the package thus achieved is rigid and firm and also easy to make. Another advantage is that after unpacking the end cover package, the protective paper and the end covers used as a part of the package are made of the same, fully recyclable material so that waste problems can be avoided. Another advantage is that there is no need to transport platforms or various plywood or similar packing covers but the goods are transported in one direction only.

The invention is described in more detail in the appended drawings, in which

Figure 2C:
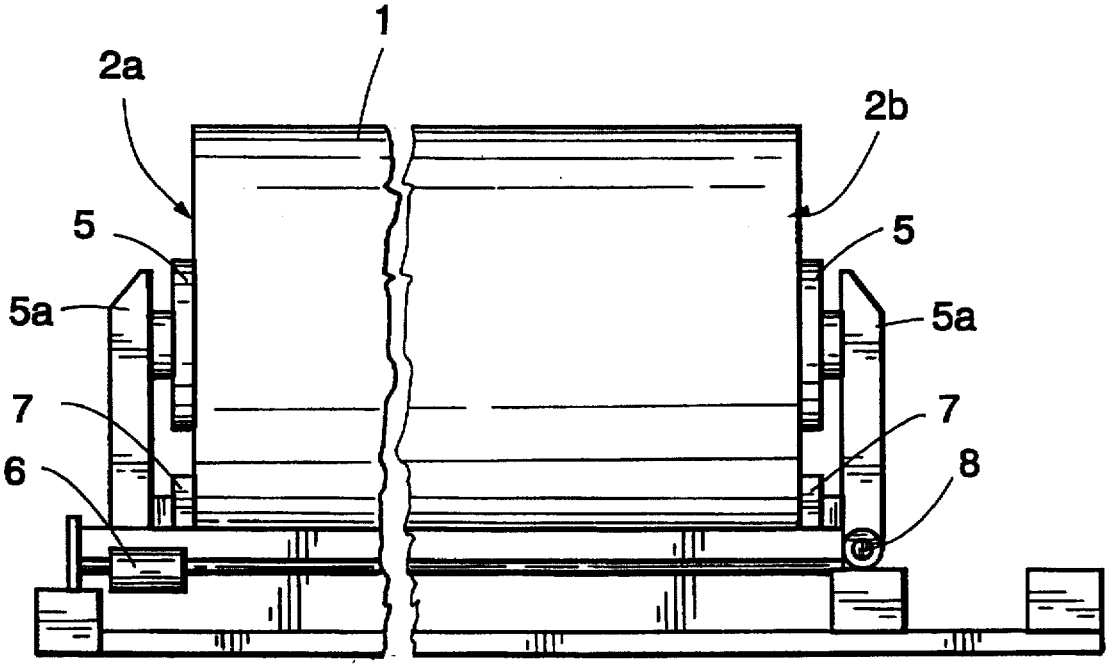
Figure 2A:
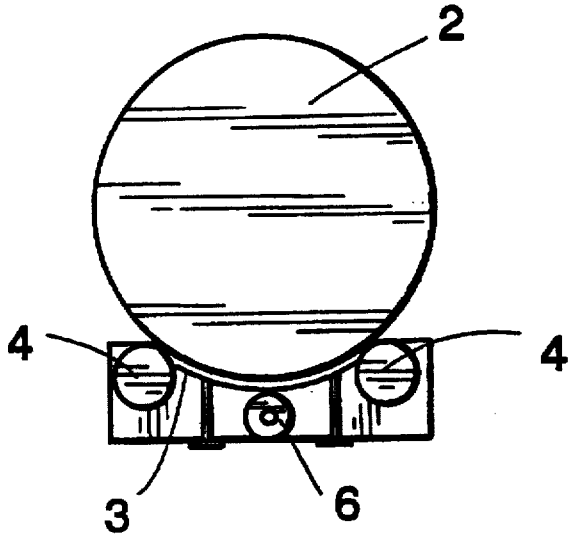
Figure 2B:
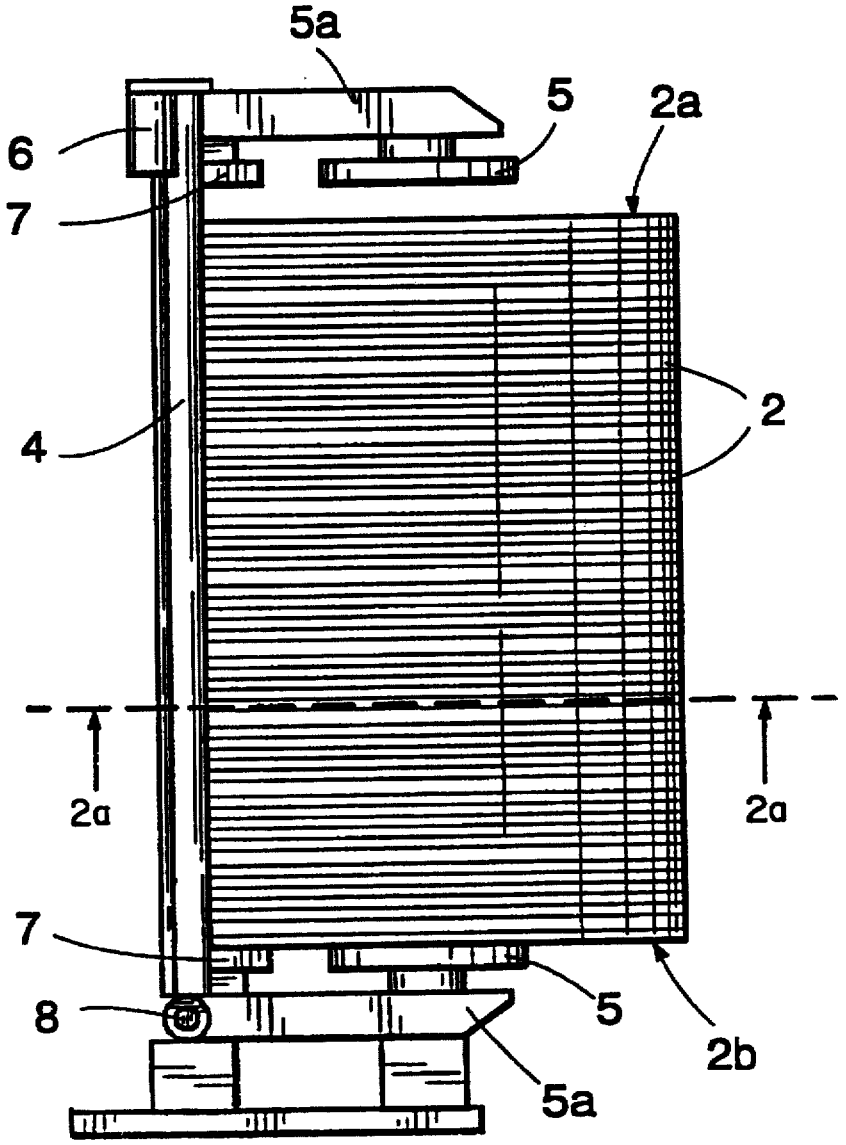

FIG. 1 shows a schematic view of the package of the invention partly cut open and FIGS. 2*a*–2*c* show schematic views of the apparatus of the invention and different stages of packing.

FIG. 1 is a schematic view of the package achieved with the method of the invention in which end covers 2 are inside a protective paper 1. The protective paper 1 is wrapped around the end covers 2 and made into a tube by fastening together the edges of the wrapped paper. The edges of the protective paper 1 that are left loose after fastening the tube are folded over the outermost end covers and fastened onto them so that the end covers together with the protective paper 1 form a unitary closed package. In FIG. 1 only one edge 1*a* of the protective paper 1 and similarly, one outermost end cover 2*a* are shown and marked.

FIGS. 2*a*–2*c* show schematic views of the apparatus of the invention and the packing according to the method at different stages. FIG. 2*a* is a schematic view of the apparatus of the invention with the end covers in place, viewed from a cross direction to the apparatus along the A—A line shown in FIG. 2*b*; FIG. 2*b* is a schematic view of the apparatus of the invention in a situation in which end covers 2 are stacked into the apparatus; and FIG. 2*c* is a schematic view of a situation in which the stacked and compressed end covers have just been covered with a protective paper. In each of these figures like numerals are used to refer to like parts.

The apparatus has a guiding trough 3 against which end covers 2 are gathered so that they make up a pile. On both sides of the guiding trough 3 there are rotating reels 4 on which the end cover pile can be reeled in order to wrap a protective paper 1 around them. At the ends of the guiding trough 3 there are compression surfaces 5, between which the end covers 2 are set when stacked. The compression surfaces 5, or at least one of them is connected to a compression means 6 by means of which the compression surfaces 5 can be moved closer to each other and thus compress the end covers between them in the elavation of the pile. The compression surfaces 5 are mounted on end frames 5a in the apparatus to be movable in their elevation in such a way that it is always possible to have them co-axially with the central axis of the end covers to be packed, regardless of the size of the end covers. Similarly, the compression surfaces 5 are mounted to be revolving so that they can revolve along with the end cover pile. The compression means 6 can simply be a screw mechanism that moves the end frame 5a on the left in the figure together with the compression surface 5 to the right so that the distance between the compression surfaces 5 will become smaller. By using a compressor screw of a suitable length or some other compressor part, an amount of required height of end covers can be packed to make a suitable transport packing. After the compression of the end covers, the protective paper 1 is supplied around the end covers 2, whereupon the guiding trough 3 leads the protective paper from underneath the end cover pile or stack to the other side of the pile and the paper is wrapped into a tubular roll. When the protective paper 1 has been wrapped, it is cut and fastened at the edges into a tube. The apparatus also comprises fixing means 7 by means of which the edges of the tubular protective paper 1 are folded over the outermost end covers 2a and 2b and fastened onto them with glue, for example. The edges of the protective paper 1 can for example be cut into strips at suitable intervals or they can be folded by means of rolls or the like at the same time as the glue is applied between the protective paper and the outermost end cover. When the protective paper 1 is fastened onto the end covers 2a and 2b, the end covers 2 are released from compression, whereupon their flexibility makes them expand in the axial direction outwards and makes the protective paper 1 tighten fast around the end covers 2. Thus a stiff cylindrical package is formed, a package that is easy to handle and has no waste-producing parts or parts requiring extra transportation back and forth. The protective paper 1 can be covered with a suitable coating material, for example, plastic which will make it highly moisture resistant. However, the coating material is most advantageously of a kind that will not prevent recycling or some other utility purpose of the protective paper. As shown in the figures, the apparatus is most preferably made into a unitary unit that has been mounted to be turnable at its one end around a horizontal shaft 8. This means that the end covers 2 can be stacked as shown in FIG. 2b when the apparatus is turned into a vertical position and after a suitable amount of end covers is stacked, the covers are compressed in a pile, after which the apparatus is turned around the shaft 8 into a horizontal position for wrapping the protective paper 1. The protective paper can naturally be wrapped also when the apparatus is in a vertical position, in which case the horizontal shaft 8 is not needed, or the apparatus can be mounted into an inclined position.

In the above specification and drawings the invention is presented only by way of example and it is by no means restricted thereto. The compression means 6 can be mounted as shown in the figures to move the end frame 5a but also, to push the other compression surface directly by placing a pressure medium cylinder, for example, on its shaft.

We claim:

1. A package of paper roll end covers, the package comprising:

a stack of end covers compressed in the direction of the axis of the stack into a smaller space than their free space, said stack having ends and a circumferential surface extending between said ends;

a protective cover comprising:

first and second end covers, positioned adjacent to the ends of the stack of end covers;

a protective sheet of material covering the entire circumferential surface of the stack of end covers; and the protective sheet of material extending beyond the ends of the stack and being secured to the first and second end covers to completely envelope the stack of end covers.

2. The package according to claim 1 wherein the protective sheet of material is fastened in a longitudinal direction of the end cover stack so that it forms a tube around the end covers.

3. The package according to claim 1 wherein the edges of the protective sheet of material are folded over the outermost end covers and fastened folded onto them.

4. A method for packing paper roll end covers for transportation, comprising the steps of:

stacking the end covers into a stack of end covers;

compressing the end cover stack in its axial direction;

wrapping the compressed end cover stack in a protective sheet of material that is wider than the width of the axial direction of the stack so that it envelops the entire end cover stack;

cutting the edges of the sheet of material at the ends of the end cover stack into strips;

folding and fastening the strip-cut edges of the protective sheet of material outside of the ends of the end cover stack onto the outermost end covers of the end cover stack so that the protective sheet of material and the outermost ends of the end cover stack form a unitary package; and releasing the end cover stack from compression.

5. A package of paper roll end covers, the package comprising:

end covers stacked and compressed in the direction of the axis of the stack into a smaller space than their free space;

a protective sheet of material around the end covers enveloping the stack of end covers;

the edges of the protective sheet of material being cut into strips and fastened onto the outermost end covers so that the outermost end covers form a unitary package with the protective paper.

6. A method for packing paper roll end covers comprising the following steps:

compressing a stack of paper roll end covers in the direction of the axis of the stack into a smaller space than their free space, said stack having ends and a circumferential surface extending between said ends, first and second of said end covers being positioned at the ends of the stack;

covering the entire circumferential surface of the stack with a protective sheet of material; and securing portions of the protective sheet of the material to the first and second end covers so the protective sheet of material and the first and second end covers together completely envelope the stack of end covers.

* * * * *